US009741182B2

(12) United States Patent
Zhu

(10) Patent No.: US 9,741,182 B2
(45) Date of Patent: Aug. 22, 2017

(54) METHOD AND CIRCUIT STRUCTURE FOR DISPLAYING STATE PARAMETERS OF CENTRAL AIR-CONDITIONING SYSTEM

(71) Applicant: Zhongshan Broad-Ocean Motor Co., Ltd., Zhongshan (CN)

(72) Inventor: Tangqun Zhu, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 58 days.

(21) Appl. No.: 14/859,375

(22) Filed: Sep. 21, 2015

(65) Prior Publication Data

US 2016/0093192 A1 Mar. 31, 2016

Related U.S. Application Data

(63) Continuation-in-part of application No. PCT/CN2014/088275, filed on Oct. 10, 2014.

(30) Foreign Application Priority Data

Sep. 29, 2014 (CN) ..... 2014 1 0522878

(51) Int. Cl.
*F24F 11/00* (2006.01)
*G07C 3/00* (2006.01)

(52) U.S. Cl.
CPC ..... *G07C 3/00* (2013.01); *F24F 11/001* (2013.01); *F24F 11/0086* (2013.01); *F24F 2011/0091* (2013.01)

(58) Field of Classification Search
CPC ..... F24F 11/001; F24F 11/0086; F24F 2011/0011; G05D 23/193
See application file for complete search history.

(56) References Cited

U.S. PATENT DOCUMENTS 4,298,946 A * 11/1981 Hartsell ..... G05D 23/1904 165/268
6,640,890 B1 * 11/2003 Dage ..... B60H 1/00821 165/203
2013/0179373 A1 * 7/2013 Mutchnik ..... G06Q 30/0283 705/412

* cited by examiner

*Primary Examiner* — Andrew Bee
(74) *Attorney, Agent, or Firm* — Matthias Scholl, PC; Matthias Scholl

(57) ABSTRACT

A method for displaying state parameters using an integrated controller. The integrated controller includes: a central control microprocessor, an LED display, an inquiry button, and a plurality of state parameter detecting units. The method includes: 1) detecting data of a plurality of monitoring points by the plurality of state parameter detecting units, and sending the data to the central control microprocessor; 2) receiving an order from the inquiry button by the central control microprocessor, and actively scanning state parameters of the monitoring points by the central control microprocessor by turns; and 3) transmitting the state parameters from the central control microprocessor to the LED display in accordance with the order input from the inquiry button, and sequentially displaying the state parameters on the LED display in a rolling mode.

13 Claims, 2 Drawing Sheets

METHOD AND CIRCUIT STRUCTURE FOR DISPLAYING STATE PARAMETERS OF CENTRAL AIR-CONDITIONING SYSTEM

CROSS-REFERENCE TO RELATED APPLICATIONS

This application is a continuation-in-part of International Patent Application No. PCT/CN2014/088275 with an international filing date of Oct. 10, 2014, designating the United States, now pending, and further claims priority benefits to Chinese Patent Application No. 201410522878.1 filed Sep. 29, 2014. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND OF THE INVENTION

Field of the Invention

The invention relates to a method and a circuit structure for displaying state parameters of a central air-conditioning system.

Description of the Related Art

Typically, to inquire the state parameters of a central air-conditioning system, a wire controller is needed, and the installation process is usually laborsome and time-consuming. In addition, because the fault codes are often displayed via two-bit nixie tubes in the display circuit, technicians need to refer to an instruction book to know the meaning of the codes. Thus, the operation process is troublesome and has high error rate.

SUMMARY OF THE INVENTION

In view of the above-described problems, it is one objective of the invention to provide a method and a circuit structure for displaying state parameters of a central air-conditioning system using an integrated controller. The method is simple and reliable. A plurality of state parameters of the system can be inquired as long as the inquiry button is pressed, thereby largely improving the efficiency. In addition, the circuit structure is simple, convenient for technicians to quickly inquire the state parameters, thus having high efficiency and high reliability.

To achieve the above objective, in accordance with one embodiment of the invention, there is provided a method for displaying state parameters of a central air-conditioning system using an integrated controller. The integrated controller comprises: a central control microprocessor, an LED display, an inquiry button, and a plurality of state parameter detecting units. The method comprises: detecting data of a plurality of monitoring points by the state parameter detecting units, and sending the data to the central control microprocessor; receiving an order from the inquiry button by the central control microprocessor, and actively scanning state parameters of the monitoring points by the central control microprocessor by turns; and transmitting the state parameters from the central control microprocessor to the LED display in accordance with the order input from the inquiry button, and sequentially displaying the state parameters on the LED display in a rolling mode.

In a class of this embodiment, the state parameters are temperature data of each monitoring point.

In a class of this embodiment, rotational speed data of an indoor blower, a compressor, and an outdoor blower are calculated by the central control microprocessor in accordance with the temperature data of each monitoring point, and the rotational speed data and the temperature data of each monitoring point are displayed in sequence on the LED display in the rolling mode.

In a class of this embodiment, the data displayed on the LED display are formed by codes and data values. The codes represent different monitoring points and data types.

In a class of this embodiment, the code is displayed by a one-to-two-bit LED nixie tube, and the data values are displayed by a two-to-four-bit LED nixie tube.

In a class of this embodiment, the temperature data of each monitoring point and the rotational speed data are displayed in sequence on the LED display in the rolling mode.

In a class of this embodiment, the inquiry button is a dial switch.

In a class of this embodiment, a program for displaying the state parameters in the rolling mode is set by the central control microprocessor, and the program comprises:

1) starting up the central air-conditioning system, and initializing the state parameter of each monitoring point in the central control microprocessor;

2) choosing an operation mode of the central air-conditioning system;

3) continuing automatic operation of the air-conditioning system when no inquiry to the state parameter of each monitoring point is needed;

4) inputting the corresponding order from the inquiry button to the central control microprocessor when any inquiry to the state parameter of each monitoring point is needed, and sequentially displaying the state parameters on the LED display in the rolling mode; and 5) ending, and returning to 3).

In accordance with another embodiment of the invention, there is provided a circuit structure for displaying state parameters according to the method. The circuit structure comprises: a power circuit, a temperature signal collection circuit, a microprocessor, a first drive circuit, an LED display circuit, and a dial switch. The dial switching comprises an input circuit. In use: the power circuit supplies power for all parts of circuits. The temperature data of each monitoring point of the central air-conditioning system are collected by the temperature signal collection circuit and input into the microprocessor. The microprocessor is connected to the input circuit of the dial switch. The order is input from the input circuit to the microprocessor. Operation of the LED display circuit is driven by the microprocessor via the first drive circuit. Rotational speed data of an indoor blower, a compressor, and an outdoor blower are calculated by the microprocessor in accordance with the temperature data of each monitoring point, and the rotational speed data and the temperature data of each monitoring point are displayed in sequence on the LED display circuit in the rolling mode. The temperature data of each monitoring point comprise: indoor temperature data, temperature data of a coil of an indoor unit, temperature data of a coil of an outdoor unit, ambient temperature data of the outdoor unit, temperature data of an exhaust pipe of the compressor, temperature data of inlet air, and temperature data of an air inlet pipe of the compressor.

In a class of this embodiment, the LED display circuit employs a four-bit LED nixie tube display. Data displayed on the four-bit LED nixie tube display is formed by codes and data values, and the codes are used to represent different monitoring points and data types.

In a class of this embodiment, the microprocessor is connected to a serial communication circuit, and the microprocessor is communicated with a blower motor via the serial communication circuit. The microprocessor is connected to a power down memory circuit and a second drive circuit. Operation of a relay control circuit is driven by the microprocessor via the second drive circuit.

Compared with existing technologies, advantages of the method for displaying state parameters and the circuit structure for realizing the same according to embodiments of the invention are as follows:

1. When the order from the inquiry button is detected by the central control microprocessor, the state parameters of the monitoring points are actively scanned by the central control microprocessor by turns, and the state parameters are displayed in sequence on the LED display in the rolling mode. The display method is easy to practice. The state parameters of the system can be browsed and inquired as long as the inquiry button is pressed, which largely improves efficiency and has high reliability, zero error and lower costs.

2. The state parameters are temperature data of each monitoring point. The rotational speed data of the indoor blower, the compressor, and the outdoor blower are calculated by the central control microprocessor in accordance with the temperature data of each monitoring point, and the rotational speed data and the temperature data of each monitoring point are displayed in sequence on the LED display in the rolling mode. The powerful computing capacity of the central control microprocessor is fully utilized, thus production cost to install a rotational speed detector is saved and market competitiveness is improved.

3. The data displayed by the LED display is formed by codes and data values. The codes are used to represent different monitoring points and data types. The LED display has a simple structure, and data are clearly displayed thereon. No more instructions or manuals are needed, which largely improves efficiency of the technicians and saves labor and resources.

4. The inquiry button is a dial switch. Compared with typical wire controller, the inquiry button of the invention has a lower cost and is easier to practice.

5. The microprocessor is connected to the input circuit of the dial switch; the order is input from the input circuit to the microprocessor. Operation of the LED display circuit is driven by the microprocessor via the first drive circuit. Rotational speed data of the indoor blower, the compressor, and the outdoor blower are calculated by the microprocessor in accordance with the temperature data of each monitoring point, and the rotational speed data and the temperature data of each monitoring point are displayed in sequence on the LED display circuit in the rolling mode. The circuit structure is simple, convenient for technicians to quickly inquire the state parameters in the system, and has a high efficiency and a high reliability.

6. The LED display circuit employs a four-bit LED nixie tube display. The LED display circuit has a simple structure, and data displayed are much abundant and clearer. No more instructions or manuals are needed for technicians to understand the specific meaning of the data displayed.

DETAILED DESCRIPTION OF THE EMBODIMENTS

For further illustrating the invention, experiments detailing a method and a circuit structure for displaying state parameters of a central air-conditioning system using an integrated controller are described below. It should be noted that the following examples are intended to describe and not to limit the invention.

Example 1

Figure 1:
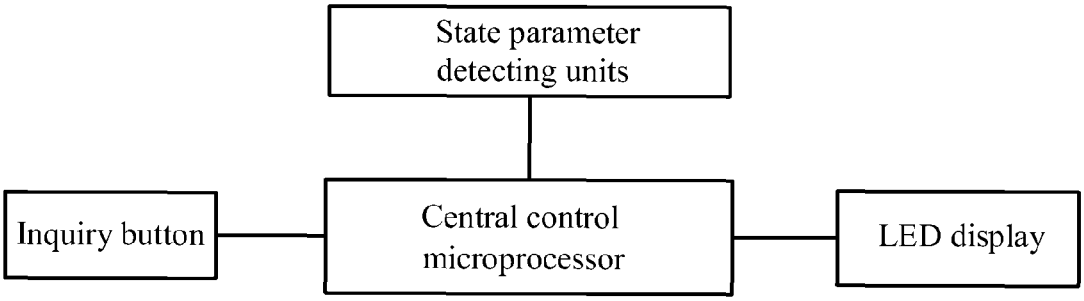
FIG. 1 is a schematic diagram of an integrated controller in a central air-conditioning system according to one embodiment of the invention.

As shown in FIG. 1, the invention relates to a method for displaying state parameters of a central air-conditioning system using an integrated controller. The integrated controller of the central air-conditioning system comprises: a central control microprocessor, an LED display, an inquiry button, and a plurality of state parameter detecting units. A plurality of state parameter detecting units detects data of a plurality of monitoring points, and sends the data to the central control microprocessor which, in accordance with the order input from the inquiry button, transmits different state parameters to the LED display for display. When the central control microprocessor detects relevant orders from the inquiry button, the central control microprocessor actively scans the state parameters in each monitoring point by turns and displays the state parameters in sequence on the LED display in a rolling mode.

The state parameters are temperature data of each monitoring point. Firstly, the central control microprocessor detects the temperature data of a plurality of monitoring points via a plurality of state parameter detecting units, and converts the temperature data into a digital signal via an A/D conversion circuit. Sampling time of each monitoring point is approximately 0.5 second, and temperature data of each monitoring point are sampled six times for averaging. The central control microprocessor stores a plurality of obtained temperature data values in a temporary variable in memory thereof. The central control microprocessor repeats the above procedure at set intervals and stores the latest obtained temperature data value in the temporary variable in memory thereof.

The temperature data of each monitoring point mainly comprises: indoor temperature data, temperature data of a coil of an indoor unit, temperature data of a coil of an outdoor unit, ambient temperature data of the outdoor unit, temperature data of an exhaust pipe of the compressor, temperature data of inlet air, and temperature data of an air inlet pipe of the compressor.

The microprocessor calculates the rotational speed data of the indoor blower, the compressor and the outdoor blower in accordance with the temperature data of each monitoring point, and specific algorithm is as follows:

The central control microprocessor estimates a real-time rotational speed of the indoor blower, the compressor, and the outdoor blower in accordance with the difference between the given temperature and the actual temperature.

Assuming that the rotational speed of the indoor blower ranges from 600 rpm to 1400 rpm. A refrigerating capacity of the central air-conditioning system ranges from 16° C. to 32° C., and is divided into 16 levels. That is to say, one degree centigrade adding to the 16° C. equals 1 level up. For example, 20° C. equals to 4 levels, and 28° C. equals to 12 levels. 800 rpm which is between 600 rpm and 1400 rpm is also divided into 16 levels, and each level equals to 50 rpm. That is to say, 50 rpm adding to the 600 rpm equals to one level up. Assuming that the given indoor temperature is 20° C., and the actual indoor temperature detected is 28° C. which is 8 levels higher than that of the given temperature, thus actual rotational speed is 600 rpm plus eight levels of 50 rpm (400 rpm), that is, the real-time rotational speed of the indoor blower is approximately 1000 rpm.

The same assumption can be applied to the compressor. Assuming that the rotational speed of the compressor ranges from 600 rpm to 1240 rpm. A refrigerating capacity of the central air-conditioning system ranges from 16° C. to 32° C., and is divided into 16 levels. That is to say, one degree centigrade adding to the 16° C. equals 1 level up. For example, 18° C. equals to 2 levels, and 25° C. equals to 9 levels. 640 rpm which is between 600 rpm to 1240 rpm is also divided into 16 levels, and each level equals to 40 rpm. That is to say, 40 rpm adding to the 600 rpm equals to one level up. Assuming that the given indoor temperature is 18° C., and the actual indoor temperature is 25° C. which is 7 levels higher than that of the given temperature, thus the actual rotational speed is 600 rpm plus seven levels of 40 rpm (280 rpm), that is, the real-time rotational speed of the compressor is around 880 rpm.

The same assumption and algorithm can be applied to the outdoor blower, and no need to repeat herein.

The central control microprocessor stores obtained rotational speed data in a temporary variable in memory thereof. The central control microprocessor repeats the above procedure at set intervals and stores the latest obtained rotational speed data in the temporary variable in memory thereof. When the central control microprocessor detects relevant orders from the inquiry button, the central control microprocessor actively scans the state parameters in each monitoring point by turns and displays the state parameters in sequence on the LED display in the rolling mode.

The data displayed by the LED display is formed by codes and data values. The codes are used to represent different monitoring points and data types. The code is displayed by a one-to-two-bit LED nixie tube, and the data values are displayed by a two-to-four-bit LED nixie tube. Different Arabic numeral codes are employed to represent the temperature data of different monitoring points, for example, 1—represents the indoor temperature data, 2—represents the temperature data of a coil of an indoor unit, 3—represents the temperature data of a coil of an outdoor unit, 4—represents the ambient temperature data of the outdoor unit, 5—represents the temperature data of an exhaust pipe of the compressor, 6—represents the temperature data of inlet air, and 7—represents the temperature data of an air inlet pipe of the compressor. A two-bit LED nixie tube is employed to display the temperature data. Also, different Chinese numeral codes are employed to represent the rotational speed data of different monitoring points, for example, Chinese character YI (one in English) represents the rotational speed data of the indoor blower, Chinese character ER (two in English) represents the rotational speed data of the compressor, Chinese character SAN (three in English) represents the rotational speed data of the outdoor blower. A three-bit LED nixie tube is employed to display the rotational data, and the three bits of the LED nixie tube display represent thousands, hundreds and tens of the rotational speed data, respectively. Thus the data on the LED display can be clearly understood. For example, 1-27 represents that the indoor temperature is 27° C., 4-30 represents that the outdoor environmental temperature is 30° C., YI075 represents that the rotational speed data of the indoor blower is 750 rpm, SAN110 represents that the rotational speed data of the outdoor blower is 1100 rpm, and so on and so forth.

The rotational speed data and the temperature data of each monitoring point are displayed in sequence on the LED display in the rolling mode. The LED display displays data in an order according to the code number every second.

The inquiry button is a dial switch. The dial switch is adapted to set up the input parameter of the central air-conditioning system and modify set values, and etc.

Figure 2:
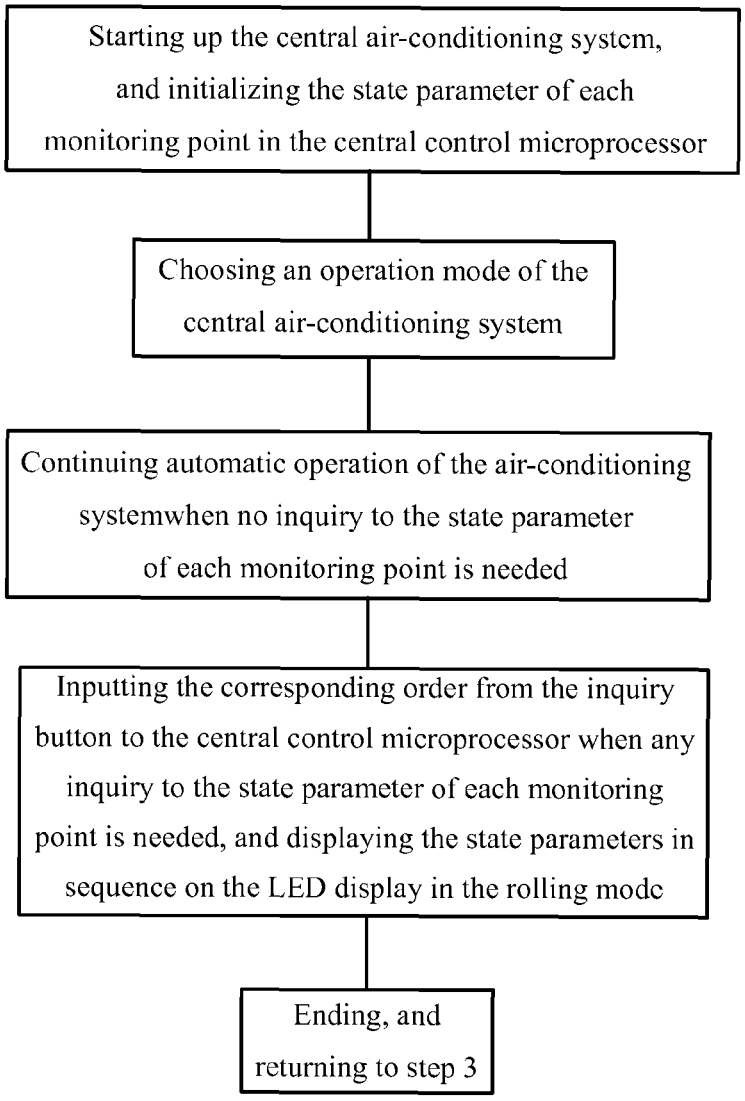
FIG. 2 is a flow chart of a program for displaying state parameters in a rolling mode according to one embodiment of the invention.

As shown in FIG. 2, a program for displaying the state parameters in the rolling mode is set by the central control microprocessor, and the program comprises:

1) starting up the central air-conditioning system, and initializing the state parameter of each monitoring point in the central control microprocessor;

2) choosing an operation mode of the central air-conditioning system;

3) continuing automatic operation of the air-conditioning system when no inquiry to the state parameter of each monitoring point is needed;

4) inputting the corresponding order from the inquiry button to the central control microprocessor when any inquiry to the state parameter of each monitoring point is needed, and displaying the state parameters in sequence on the LED display in the rolling mode; and 5) ending, and returning to 3).

The operation mode of the central air-conditioner mainly comprises: a ventilation mode, a refrigeration mode, a heating mode, a dehumidification mode, an automatic mode, a stop mode, and a heatpump mode.

Example 2

Figure 3:
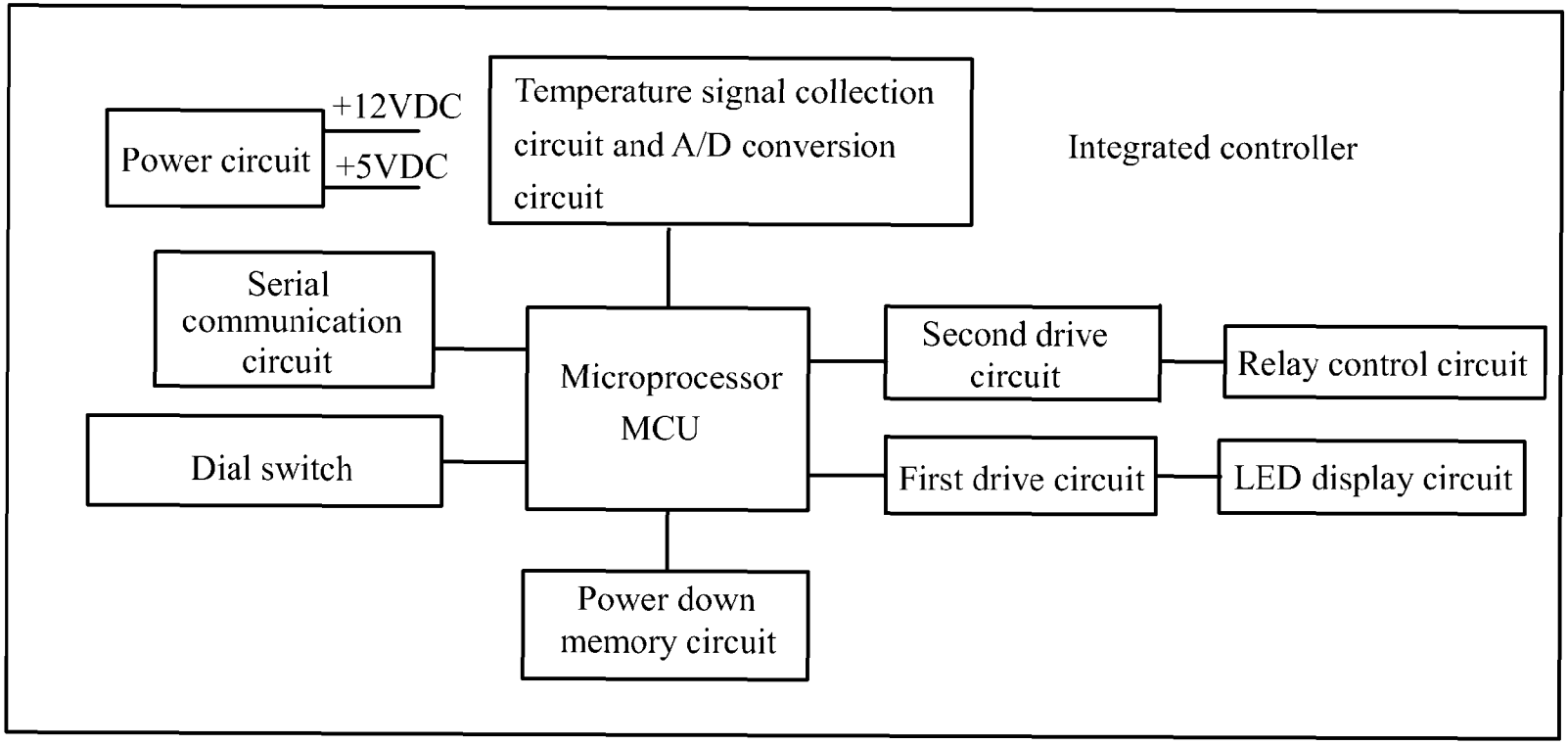
FIG. 3 is a circuit diagram of an integrated controller in a central air-conditioning system according to one embodiment of the invention.

As shown in FIG. 3, the invention relates to a circuit structure of the integrated controller in the central air-conditioning system. The circuit structure comprises: a power circuit, a temperature signal collection circuit, a microprocessor, a first drive circuit, and an LED display circuit. The power circuit supplies 12 VDC for the first drive circuit and the LED display circuit and 5 VDC for the temperature signal collection circuit and the microprocessor. The temperature signal collection circuit collects the temperature data of each monitoring point of the central air-conditioning system. An A/D conversion circuit converts the obtained temperature data analog signal into digital signals and inputs into the microprocessor. The microprocessor is connected to an input circuit of a dial switch. The input circuit of the dial switch are employed to set up the input parameter of the central air-conditioning system and modify set values, and etc. The input circuit inputs a control order to the microprocessor, and the microprocessor drives an operation of the LED display circuit via the first drive circuit. The microprocessor calculates the rotational speed data of the indoor blower, the compressor and the outdoor blower in accordance with the temperature data of each monitoring point, and displays the rotational speed data and the temperature data of each monitoring point on the LED display circuit in sequence in a rolling mode. The temperature data of each monitoring point mainly comprises: indoor temperature data, temperature data of a coil of an indoor unit, temperature data of a coil of an outdoor unit, ambient temperature data of the outdoor unit, temperature data of an exhaust pipe of the compressor, temperature data of inlet air, and temperature data of an air inlet pipe of the compressor.

The LED display circuit employs a four-bit LED nixie tube display. Data displayed on the four-bit LED nixie tube display is formed by codes and data values, and the codes are used to represent different monitoring points and data types.

The microprocessor is connected to a serial communication circuit. The microprocessor is communicated with the blower motor via the serial communication circuit. The microprocessor transmits data and order to the blower motor via the serial communication circuit, and control the rotational speed and air volume of the blower motor. The microprocessor is connected to a power down memory circuit and a second drive circuit. The microprocessor drives an operation of a relay control circuit via the second drive circuit. The relay control circuit is employed to drive and control motors such as the indoor blower, the outdoor blower, the compressor, and etc. When the central air-conditioning system is suddenly power off, the power down memory circuit can transmit data stored inside to the microprocessor so as to avoid data loss resulting from the sudden power cut. Meanwhile the power down memory circuit can reset the parameters and examine data. The circuit structure is simple and the operation thereof is convenient and stable.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for displaying state parameters of a central air-conditioning system using an integrated controller; the integrated controller comprising a central control microprocessor, an LED display, an inquiry button, and a plurality of state parameter detecting units; and the method comprising:

1) detecting data of a plurality of monitoring points by the plurality of state parameter detecting units, and sending the data to the central control microprocessor;
2) receiving an order from the inquiry button by the central control microprocessor, and actively scanning state parameters of the monitoring points by the central control microprocessor by turns; and
3) transmitting the state parameters from the central control microprocessor to the LED display in accordance with the order input from the inquiry button, and sequentially displaying the state parameters on the LED display in a rolling mode;

wherein:

the state parameters comprise temperature data of each monitoring point; and rotational speed data of an indoor blower, a compressor, and an outdoor blower are calculated by the central control microprocessor in accordance with the temperature data of each monitoring point, and the rotational speed data and the temperature data of each monitoring point are displayed in sequence on the LED display in the rolling mode.

2. The method of claim 1, wherein the state parameters displayed on the LED display are formed by codes and data values; and the codes represent different monitoring points and data types.

3. The method of claim 2, wherein the codes are displayed by a one-to-two-bit LED nixie tube, and the data values are displayed by a two-to-four-bit LED nixie tube.

4. The method of claim 1, wherein the inquiry button is a dial switch.

5. The method of claim 1, wherein the central control microprocessor comprises a program for displaying the state parameters in the rolling mode, and the program comprises:

1) starting up the central air-conditioning system, and initializing the state parameter of each monitoring point in the central control microprocessor;
2) choosing an operation mode of the central air-conditioning system;
3) continuing automatic operation of the air-conditioning system when no inquiry to the state parameter of each monitoring point is needed;
4) inputting the corresponding order from the inquiry button to the central control microprocessor when any inquiry to the state parameter of each monitoring point is needed, and displaying the state parameters in sequence on the LED display in the rolling mode; and
5) ending, and returning to 3).

6. A circuit structure for displaying state parameters of a central air-conditioning system, the circuit structure comprising:

a) a power circuit, the power circuit being adapted to supply power for circuits;
b) a temperature signal collection circuit;
c) a microprocessor;
d) a first drive circuit;
e) an LED display circuit; and
f) a dial switch, the dial switching comprising an input circuit;

wherein:

the temperature signal collection circuit is adapted to collect and input temperature data of each monitoring point of the central air-conditioning system into the microprocessor;

the microprocessor is connected to the input circuit of the dial switch; the order is input from the input circuit to the microprocessor; the microprocessor drives the LED display circuit to operate via the first drive circuit;

in operation, rotational speed data of an indoor blower, a compressor, and an outdoor blower are calculated by the microprocessor in accordance with the temperature data of each monitoring point, and the rotational speed data and the temperature data of each monitoring point are displayed in sequence on the LED display circuit in the rolling mode; and the temperature data of each monitoring point comprise: indoor temperature data, temperature data of a coil of an indoor unit, temperature data of a coil of an outdoor unit, ambient temperature data of the outdoor unit, temperature data of an exhaust pipe of the compressor, temperature data of inlet air, and temperature data of an air inlet pipe of the compressor.

7. The circuit structure of claim 6, wherein the LED display circuit employs a four-bit LED nixie tube display; and data displayed on the four-bit LED nixie tube display are formed by codes and data values, and the codes are used to represent different monitoring points and data types.

8. The circuit structure of claim 6, wherein the microprocessor is connected to a serial communication circuit, and the microprocessor is communicated with a blower motor via the serial communication circuit;

the microprocessor is connected to a power down memory circuit and a second drive circuit; and the microprocessor drives a relay control circuit to operate via the second drive circuit.

9. The circuit structure of claim 7, wherein the microprocessor is connected to a serial communication circuit, and the microprocessor is communicated with a blower motor via the serial communication circuit;

the microprocessor is connected to a power down memory circuit and a second drive circuit; and the microprocessor drives a relay control circuit to operate via the second drive circuit.

10. The circuit structure of claim 6, wherein the state parameters are temperature data of each monitoring point.

11. The circuit structure of claim 10, wherein the state parameters displayed on the LED display circuit are formed by codes and data values; and the codes represent different monitoring points and data types.

12. The circuit structure of claim 11, wherein the codes are displayed by a one-to-two-bit LED nixie tube, and the data values are displayed by a two-to-four-bit LED nixie tube.

13. The circuit structure of claim 10, wherein the microprocessor comprises a program for displaying the state parameters in the rolling mode, and the program comprises:

1) starting up the central air-conditioning system, and initializing the state parameter of each monitoring point in the microprocessor;

2) choosing an operation mode of the central air-conditioning system;

3) continuing automatic operation of the air-conditioning system when no inquiry to the state parameter of each monitoring point is needed;

4) inputting the corresponding order from the input circuit to the microprocessor when any inquiry to the state parameter of each monitoring point is needed, and displaying the state parameters in sequence on the LED display in the rolling mode; and 5) ending, and returning to 3).

* * * * *